US005109689A

United States Patent [19]

D'Avanzo

[11] Patent Number: 5,109,689

[45] Date of Patent: May 5, 1992

[54] HOT-ROLLING PROCESS FOR SEAMLESS TUBES WITH PRELIMINARY DIAMETER REDUCTION OF THE SEMIFINISHED PRODUCTS

[75] Inventor: Raimondo D'Avanzo, Bergamo, Italy

[73] Assignee: Dalmine S.p.A., Milan, Italy

[21] Appl. No.: 619,188

[22] Filed: Nov. 27, 1990

[30] Foreign Application Priority Data

Nov. 30, 1989 [IT] Italy ..... 22559 A/89

[51] Int. Cl.[5] ..... B21B 17/04; B21B 19/04

[52] U.S. Cl. ..... 72/97; 72/208; 72/370

[58] Field of Search ..... 72/68, 96, 97, 206, 72/208, 368, 370

[56] References Cited

U.S. PATENT DOCUMENTS 4,375,160 3/1983 Verdickt ..... 72/370
4,480,457 11/1984 Möltner ..... 72/208
4,571,970 2/1986 Möltner et al. ..... 72/97
4,798,071 1/1989 Staat et al. ..... 72/97

*Primary Examiner*—Lowell A. Larson
*Assistant Examiner*—Thomas C. Schoeffler
*Attorney, Agent, or Firm*—Kenyon & Kenyon

[57] ABSTRACT

In an improved process for hot-rolling of seamless tubes with preliminary diameter reduction of the semifinished products (axially pierced round blanks), the coreless reduction step (without mandrel) occurs immediately before the step of continuous rolling on a mandrel and practically at the same time of driving the mandrel into the pierced blank, without interferences therebetween. The apparatus carrying out this operation is positioned immediately upstream of the continuous mill with mandrel, so as to form with this a single unit on the same line, thus reducing the need for room, the operation time and consequently the blank cooling before rolling, whereby the last stand of the rolling mill is reached at a sufficient temperature for rolling without any need of intermediate heating steps.

7 Claims, 4 Drawing Sheets

Fig. 1
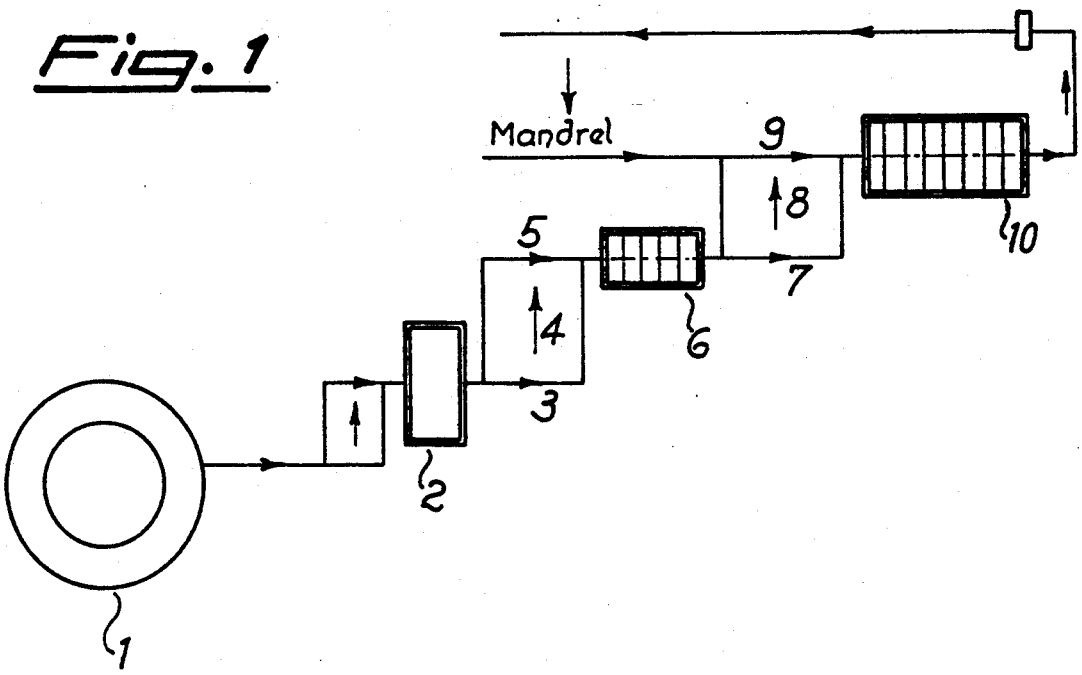
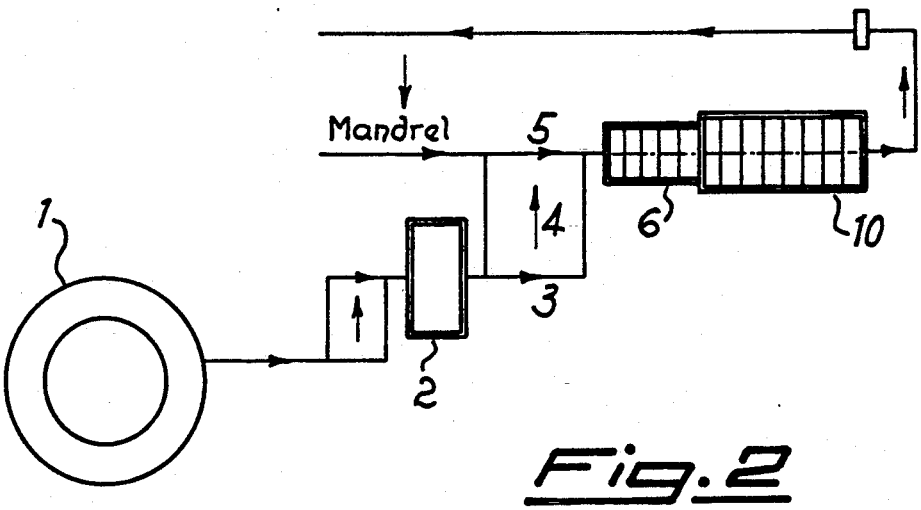
Fig. 2

HOT-ROLLING PROCESS FOR SEAMLESS TUBES WITH PRELIMINARY DIAMETER REDUCTION OF THE SEMIFINISHED PRODUCTS

The present invention relates to an improved hot-rolling process for seamless tubes with preliminary diameter reduction of the pierced round blanks by means of a rolling mill for blanks reduction of the conventional type.

It is known that in the manufacture of seamless tubes of metal or metallic alloys, particularly steel, having diameters defined as of small or medium-small size, i.e. not greater than about 170 mm, one of the most common processes is at present that of rolling on a mandrel. According to this process, the starting material in the form of a round billet obtained through one of the known technological processes, is heated in an oven up to a temperature suitable for rolling (about 1300° C. for steel) and thereafter it undergoes a rolling process comprising various successive steps carried out by some main machines which very often are provided e.g. by a piercing mill with skew rolls to obtain from said billet a hollow body of big thickness, being called "pierced blank"; a continuous rolling mill formed of a series of multi-rolls stands which, by rolling the blank on a mandrel previously fed therein, progressively reduces the thickness thereof down to a size near to the finished tube size; and finally a drawing mill formed of a series of stands with two or more rolls each for coreless reducing the outer diameter until reaching the desired final size.

Obviously the number, arrangement and constructional characteristics of these machines may vary, according to the needs, to follow the requirements of the common technological knowledges. Furthermore the limits imposed to the various machines by technology and layout define the cross-section reductions which are possible, and consequently the diameter size at the various rolling steps. In particular the diameters of the initial round billets are chosen and determined according to the diameter size that is desired for the finished products. In fact from a specific diameter of starting billet a precise series of outer diameters of the finished tube can be obtained, which series is defined by the structural features of both the continuous rolling mill and the drawing mill.

It is also known that the least expensive technology of manufacturing the raw round billet is that of the continuous casting process from the melt metal, then using directly the billet without preliminary processing before forming the pierced blank. However the continuous casting process is particularly advantageous, under the point of view of both the manufacturing costs and the quality of the product, only for diameter sizes greater than minimum size which may be defined, according to the present state of the art, as a minimum value of the billet diameter of 150 mm. By way of example a particular method of optimization of a plant designed to manufacture finished tubes with outer diameter of 20–90 mm would require to start from a round billet having a diameter of 120 mm, i.e. less than the minimum size that can be satisfactorily produced by the most common continuous casting plants. A billet of this size not only is of a quality that not always is reliable, but also is expensive and hardly available in the trade.

In order to overcome this inconvenience a rolling mill for reducing the diameter of pierced blanks has been used for some time to reduce the outer diameter of the billet already pierced by a piercing mill with skew rolls, thus modifying the outer diameter from a size that is more convenient for the continuous casting plants to a size required to enter the rolling mill with mandrel. Furthermore with the provision of an intermediate machine the correspondence between the initial diameter of the billet and that of the finished tube is made less rigidly univocal, whereby the number of diameter sizes of the raw billets which are required for a given range of diameter sizes of the finished tubes may be reduced, thus simplifying the supplying operation through a less differentiated stored stock.

At present, according to the existing state of the art, the apparatus for reducing the blank diameter is installed as a separate machine between the piercing mill with skew rolls and the rolling mill with mandrel according to a layout as shown in FIG. 1. This layout shows, with respect to a non-optimized plant, i.e. a process not providing for the step of preliminary diameter reduction of the blanks, some inconveniences mainly due to the considerable demand of room to be occupied by the feed facilities 5 relating to the blank reduction rolling mill 6 for feeding the latter with the blanks from the piercing mill with skew rolls 2, by the discharge facilities 3 for said blanks from the piercing mill 2 and by the handling means 4 between the discharging and feeding lines, respectively 3 and 5, as well as by the discharging and handling means, respectively 7 and 8, of the pierced blanks from the reducing rolling mill 6 to the station 9 for feeding mandrels before the continuous rolling mill 10 with mandrels. This results not only in an additional high cost of the facilities and systems of feeding, discharging and handling, but also in a sensible increasing of the time between the outlet of the blank from piercing mill 2 and its inlet into the rolling mill 10 with mandrel, thus giving rise to a harmful lowering of temperature of the blank to be rolled (FIG. 8) and an additional secondary oxidation of the inner and outer surface of the pierced blank. The temperature decrease may compromise the rolling itself in an additional intermediate heating step is not provided, which obviously involves additional costs. In any case cooling and secondary oxidation give rise to negative consequences to the forces required for rolling, the ductility of the material to be rolled, as well as the surface quality of the finished tube, as it is known to those skilled in the art.

Therefore it is an object of the present invention to provide an improved rolling process for seamless tubes which does not show any of the above-mentioned drawbacks, although the advantages given by an optimized process with intermediate step of diameter reduction are kept unchanged.

The process according to the invention, comprising a step of coreless diameter reduction of the pierced blank before rolling on a mandrel, is characterized by the fact that said reduction step of the blank without mandrel is carried out immediately before and on the same line of the continuous rolling step, preferably at the same time as the mandrel is driven into the blank.

It is also an object of the present invention a rolling plant for manufacturing seamless tubes, in particular of small diameter, comprising a heating oven, a piercing mill with skew rolls, a rolling mill for coreless reducing the diameter of pierced blanks and a continuous rolling mill with mandrel, characterized by the fact that said coreless reducing mill is positioned immediately upstream of the continuous mill with mandrel, so as to form therewith a single unit, preferably in correspondence with the mandrel feeding station.

These and additional objects, advantages and features of the process according to the invention, and of the plant carrying out the process will result more clearly from the following detailed description of an embodiment thereof, given by way of a non limiting example with reference to the annexed drawings, in which:

FIG. 1 shows a diagrammatic view of a rolling plant for seamless tubes with preliminary reduction of the pierced blank diameter according to the prior art;

FIG. 2 shows a diagrammatic view of an example of a coreless (without mandrel) reducing mill, in line with a continuous rolling mill with mandrel according to the invention;

Figure 8:
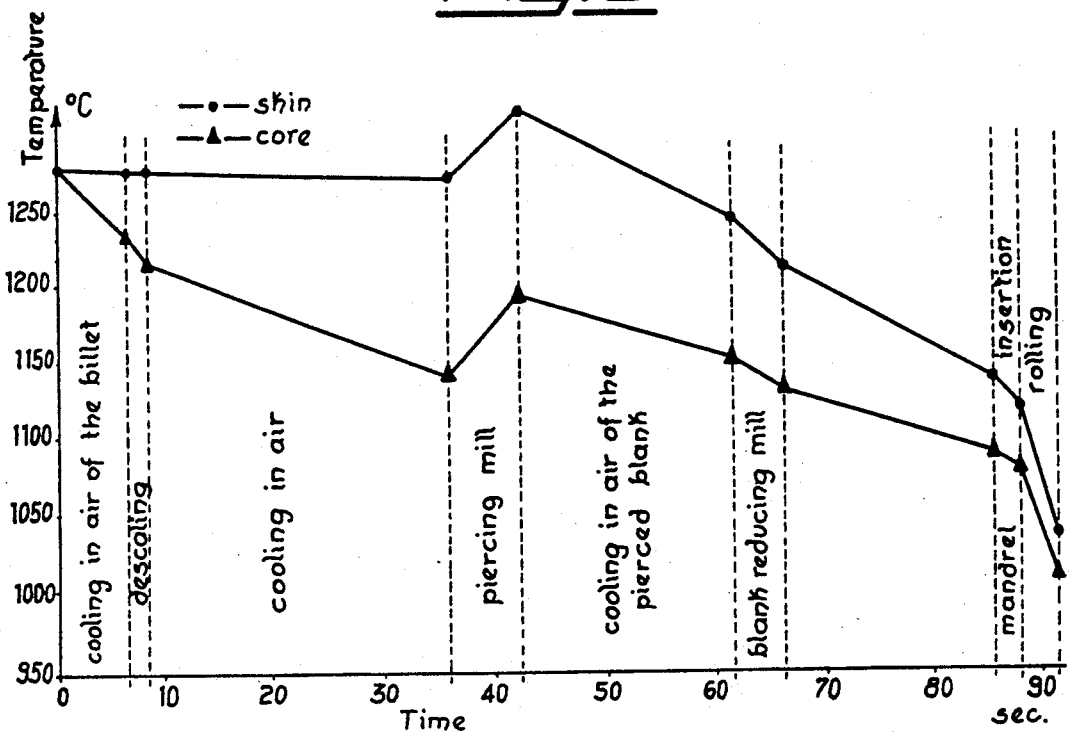
Figure 9:
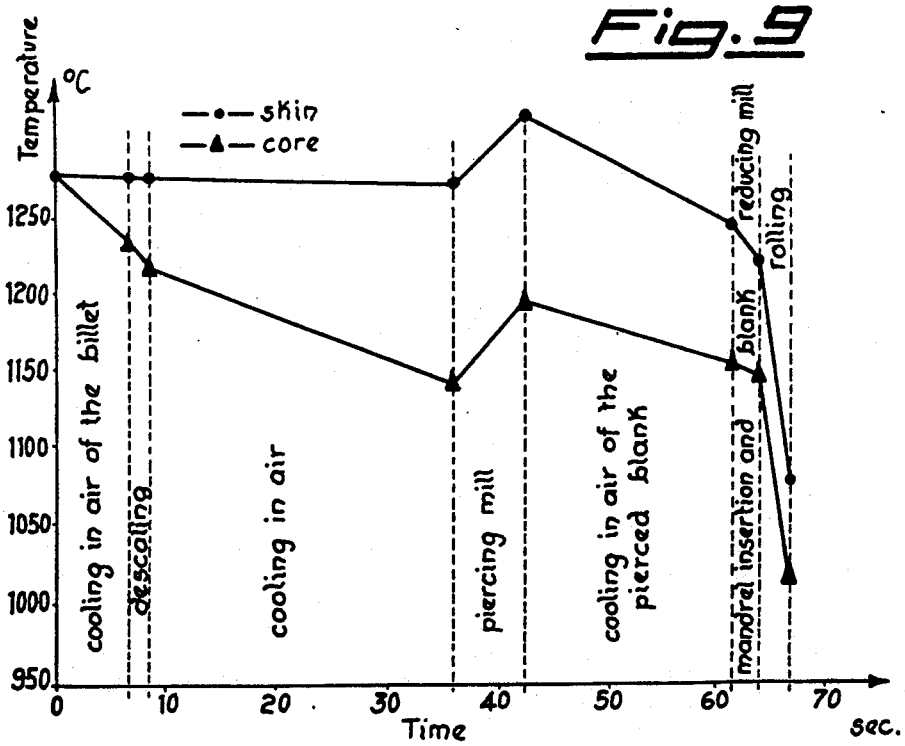

FIG. 8 shows a graph of the temperature variation, respectively at the skin and the core of the bar or billet, starting from the oven until the exit of tube from the continuous rolling mill, before the last step of reduction by drawing (not considered in the present description), for a process according to the prior art; and FIG. 9 shows the same diagram of temperatures of FIG. 8 for a process according to the invention.

With reference to the drawings, as already stated above, FIG. 1 shows a diagrammatic representation or a layout of a known plant carrying out the conventional process of manufacturing seamless tubes, being optimized by the fact of comprising a coreless reducing mill 6 of the pierced blanks between the piercing mill 2 and the continuous rolling mill 10 with mandrel. In the foregoing it has been already observed which are the inconveniences due to the space being occupied, the increasing of costs and the longer time of processing that results in a considerable cooling until reaching temperature values which, at the continuous rolling mill on mandrel, are near to or even lower than the values generally admitted for rolling, of about 1180° C. (for the steel), as can be seen in FIG. 8. Referring to FIG. 2 the process according to the invention provides for causing a bar or billet to exit from heating oven, carrying the same to a piercing mill 2 and feeding the pierced blank therefrom, through transfer lines 3, 4, 5 to a pierced blank reducing mill 6 which is designed and made according to the prior art, and according to the invention is installed directly upstream of, adjacent to a rolling mill 10 with mandrel, whereby these machines form a single unit.

Figure 3:
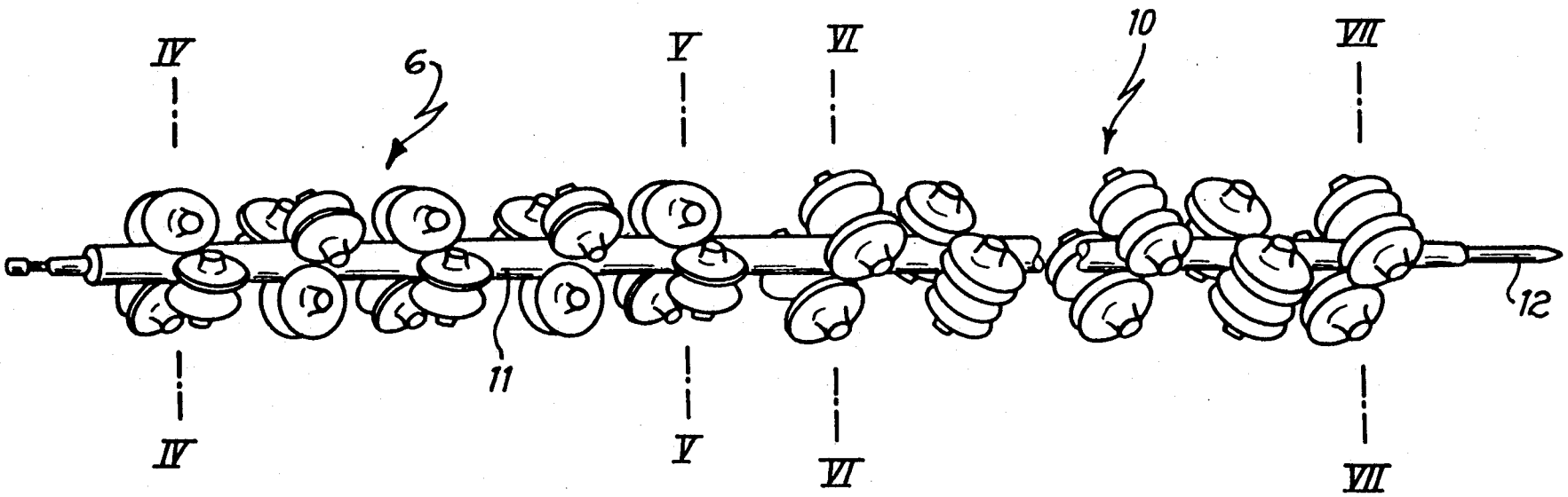
FIG. 3 shows a diagrammatic view of an example of a coreless (without mandrel) reducing mill, in line with a continuous rolling mill with mandrel according to the invention.

It should be noted that the pierced blank feed 5 to the reducing mill 6 in this case is concident with the mandrel feeding station for the mandrels to be used in the mill 10. Therefore the operating steps of the process according to the invention comprise, subsequent to discharging the bar from the heating oven 1 and its carrying to the piercing mill 2, the handling of pierced blank to the mandrel feeding station, where the mandrel is driven into the pierced blank, then passing together with the latter through the blank reducing mill and the rolling mill on mandrel 10 in an immediate succession, as is better seen in FIG. 3, in which 11 designates the pierced blank and 12 the mandrel.

Figure 4:
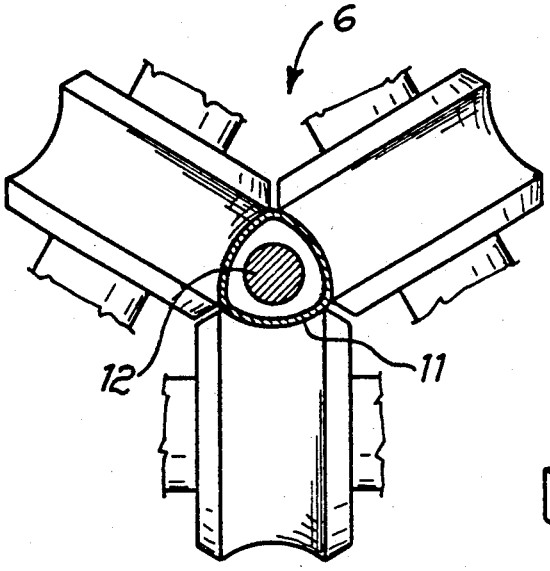
FIGS. 4,5 show cross-section views, respectively taken along lines IV—IV and V—V in correspondence with the first and the last roll stand of the reducing mill.
Figure 5:
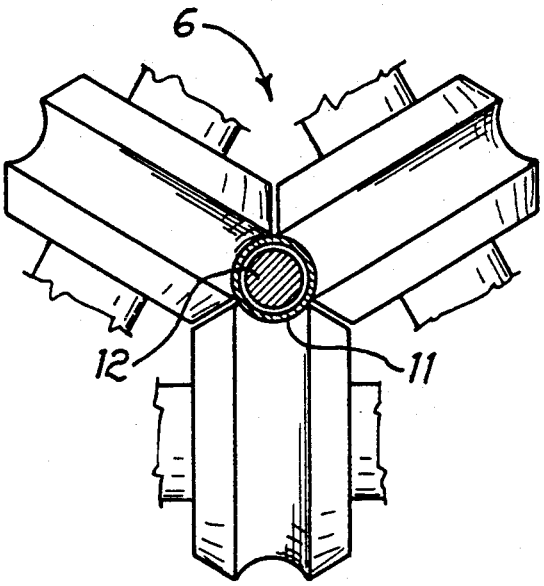
Figure 6:
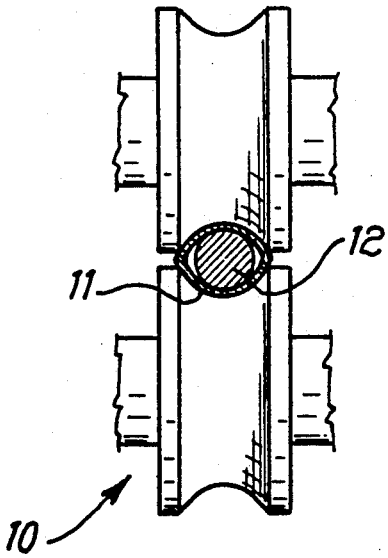
FIGS. 6,7 show cross-section views, respectively taken along lines VI—VI and VII—VII in correspondence with the first and the last roll stand of the continuous rolling mill with mandrel.
Figure 7:
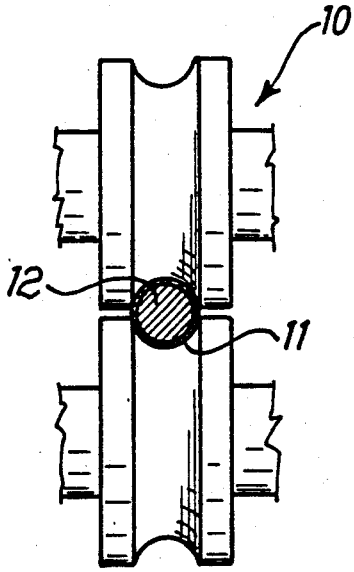

With particular reference to FIGS. 4–7 it is noted that the diameter reduction in 6 is actually performed "coreless", i.e. without contact with mandrel 12, as it were not present at the inside of blank 11, in the same way as the conventional method of FIG. 1, when the mandrel was to be fed only at a later time. Therefore it will be appreciated that with the process and related plant of this invention the mandrel 12, in spite of having also to pass longitudinally throughout the reducing mill 6, in addition to rolling mill 10, shall have the same length as required with the prior systems of FIG. 1, since during the reduction step the mandrel moves forward coaxially and at the same time with blank 11 while the diameter of the latter is reduced, without any inteference therewith (FIG. 4,5). Mandrel and pierced blank come into contact each other only starting from the first stand of rolling mill 10, as it occurred in the prior art. In fact it is should be considered that the speed and mutual spacing between rolls of the stands of the blank reducing mill 6 are adjusted automatically for this purpose, e.g. by means of a programmable logic suitable to control at the same time two machines at different speeds, so that at each moment the mandrel position is the prefixed one. With interlocking arrangements of this type depending on the regulation of rolling mill 10, the synchronization of the various parts of the plant and the exact feeding of pierced blank to the first stand of rolling mill are ensured automatically and under whichever condition.

When comparing FIGS. 1 and 2 is clearly seen that with the layout of machines as provided by the present invention there is no need of feeding, discharging and handling facilities, in particular those referred to as 7–9 in addition to those being strictly necessary for carrying out the non optimized operational cycle, i.e. such that no preliminary reduction of the blank diameter is provided. The advantages of the solution proposed by the present invention are thereby evident under the aspects of room required and of installation and operating costs.

In particular the conveying time for moving from piercing roll 2 to the continuous rolling mill does not change in consequence of installing the blank reducing mill and practically the diagram of temperatures given at FIG. 9 is the same as it would be for a non-optimized plant, showing no coreless reducing mill.

Another advantage obtained with the process and plant of the invention is that the mandrel 12 being present at the inside of the pierced blank 11 when passing through the reducing stands 6 puts a limit to oxidation of the blank inner surface, owing to the decreased cross-section for passage of air caused by mandrel 12 and possible presence of antioxidizer agents provided on the mandrel surface. This effect is of course the more important, the greater is the affinity with air shown by the blank metal.

With reference to the example referred to in the foregoing, relating to a modification of an existing plant in order to use round billets with a diameter of 150 mm instead of 120 mm, the advantages which can be obtained with the proposed solution may be summarized as from the following table.

TABLE

| | Solution with separate machine (A) | Solution with unitary machine (B) | Difference (A − B) |
|---|---|---|---|
| Area required for installation of the pierced blank reducing mill | 80 $m^2$ | 30 $m^2$ | −50 $m^2$ (−62,5%) |
| Transferring time from the exit of peircing mill to entering the rolling mill on mandrel | 45 sec. | 25 sec. | −20 sec. (−44,4%) |
| Temperature at the inlet of rolling mill on mandrel with temperature at the exit of oven of 1280° C. | 1100° C. | 1180° C. | +80° C. |

Possible additions and/or modifications can be adopted by those skilled in the art to the above-described and illustrated embodiment of the process according to the present invention and the related plant without exceeding the scope of the invention itself. In particular further operating steps could be provided, more or less associated to the pierced blank rolling, such as descaling, etc.

I claim:

1. An improved process for hot-rolling of seamless tubes of medium-small diameter comprising coreless reduction without touching a mandrel in which a pierced blank is reduced and then continuously hot-rolled to a desired diameter size and wall thickness by continuous rolling on a mandrel, wherein said coreless reduction is carried out at a reducing mill immediately upstream of a continuous rolling step which uses a mandrel, whereby the coreless reduction and continuous rolling are performed in close and quick sequence on the same line, with said mandrel being introduced into said pierced blank without touching it, at the location of said reducing mill.

2. A process according to claim 1, wherein said step of coreless reduction of the blank is carried out at the same time as feeding the mandrel into the said blank.

3. A rolling plant for the manufacture of seamless tubes, in particular of small diameter, comprising a heating oven, a piercing mill with skew rolls, a coreless (without mandrel) diameter reducing mill for pierced blanks, a continuous rolling mill on mandrel with a feeding station for inserting mandrels into the blanks and control means, wherein said reducing mill is installed immediately upstream of the rolling mill, whereby a single unit is formed therewith.

4. A plant according to claim 3, wherein the feeding station for said blanks into said coreless reducing mill is coincident with said mandrel feeding station.

5. A plant according to claim 4, wherein said pierced blanks and mandrels pass throughout said coreless reducing mill coaxially and without any interference therebetween until entering a first stand of said rolling mill where blank and mandrel come into contact.

6. A plant according to claim 5, further comprising automatic control means for rolls and stands of the reducing mill interlocked to the control means of rolling mill.

7. A plant according to claim 3, wherein said mandrel is coated with antioxidizer substances along its whole lateral surface.

* * * * *